US011583057B2

(12) United States Patent
Roualdes et al.

(10) Patent No.: US 11,583,057 B2
(45) Date of Patent: Feb. 21, 2023

(54) STEM WITH BAYONET CLOSURE AND DEVICE EQUIPPED THEREWITH

(71) Applicant: L'Oreal, Paris (FR)

(72) Inventors: Marine Roualdes, Clichy (FR); Marc Ramet, Clichy (FR); Alexandra Marin, Clichy (FR); Marc Lechanoine, Kawasaki (JP); Gilles Coatrieux-Loppes, Clichy (FR)

(73) Assignee: L'OREAL, Paris (FR)

( * ) Notice: Subject to any disclaimer, the term of this patent is extended or adjusted under 35 U.S.C. 154(b) by 257 days.

(21) Appl. No.: 16/642,799

(22) PCT Filed: Sep. 1, 2017

(86) PCT No.: PCT/JP2017/032389
§ 371 (c)(1),
(2) Date: Feb. 27, 2020

(87) PCT Pub. No.: WO2019/043955
PCT Pub. Date: Mar. 7, 2019

(65) Prior Publication Data

US 2020/0253357 A1 Aug. 13, 2020

(51) Int. Cl.
*A45D 40/26* (2006.01)
*A45D 34/04* (2006.01)
(Continued)

(52) U.S. Cl.
CPC ..... *A45D 40/267* (2013.01); *A45D 34/043* (2013.01); *A45D 34/046* (2013.01);
(Continued)

(58) Field of Classification Search
CPC .... A45D 34/04; A45D 34/041; A45D 34/042; A45D 34/043; A45D 34/045;
(Continued)

(56) References Cited

U.S. PATENT DOCUMENTS 8,459,891 B2 * 6/2013 Lhoyer ..... A45D 40/268 401/122
10,130,157 B2 * 11/2018 Fogueteiro ..... A45D 40/267
(Continued)

FOREIGN PATENT DOCUMENTS

CN 1997524 A 7/2007
CN 201958057 U 9/2011
(Continued)

OTHER PUBLICATIONS

Notice of Grounds for Rejection dated Jun. 18, 2021, issued in Korean Application No. 10-2020-7007453, filed Mar. 13, 2020, 14 pages.
(Continued)

*Primary Examiner* — David J Walczak
(74) *Attorney, Agent, or Firm* — Christensen, O'Connor, Johnson, Kindness PLLC

(57) ABSTRACT

A cosmetic device of longitudinal axis X including a bottle of product including a top free edge defining an opening, a detachable cap including a handle arranged at a first end of a stem, a second end of the stem being fastened to an application member, the stem includes a first relief able to be removably engaged in a second complementary relief arranged on the bottle.

12 Claims, 3 Drawing Sheets

(51) Int. Cl.
*B65D 51/24* (2006.01)
*B65D 51/32* (2006.01)

(52) U.S. Cl.
CPC ..... *A45D 40/264* (2013.01); *B65D 51/242* (2013.01); *B65D 51/32* (2013.01); *A45D 34/045* (2013.01); *A45D 40/265* (2013.01)

(58) Field of Classification Search
CPC .... A45D 34/046; A45D 34/047; A45D 40/26; A45D 40/261; A45D 40/262; A45D 40/264; A45D 40/265; A45D 40/267; A45D 40/268; B65D 51/242; B65D 51/32; B65D 51/18
USPC ..... 401/122–130
See application file for complete search history.

(56) References Cited

U.S. PATENT DOCUMENTS

| | | | | |
|---|---|---|---|---|
| 10,251,461 | B2 * | 4/2019 | Liard | A45D 40/267 |
| 2005/0249538 | A1 | 11/2005 | Patel et al. | |
| 2007/0110502 | A1 | 5/2007 | Salciarini et al. | |
| 2010/0143021 | A1 | 6/2010 | De Laforcade | |
| 2011/0222955 | A1 | 9/2011 | Thorpe | |
| 2011/0299910 | A1 | 12/2011 | Crutch et al. | |
| 2015/0071696 | A1 * | 3/2015 | Weigel | A45D 40/265 401/129 |
| 2016/0083153 | A1 * | 3/2016 | Apodaca | A45D 40/265 220/255 |
| 2017/0224089 | A1 | 8/2017 | Fogueteiro et al. | |

FOREIGN PATENT DOCUMENTS

| | | | |
|---|---|---|---|
| CN | 102652596 | A | 9/2012 |
| CN | 203624159 | U | 6/2014 |
| FR | 2697506 | A1 | 5/1994 |
| JP | 63003308 | U | 1/1988 |
| JP | 06-501871 | A | 3/1994 |
| JP | H09215521 | A1 | 8/1997 |
| JP | 11263362 | A | 9/1999 |
| JP | 2002034645 | A | 2/2002 |
| JP | 3118830 | U | 2/2006 |
| JP | 2007-536075 | A | 12/2007 |
| KR | 200412628 | Y | 3/2006 |
| KR | 10-2010-0125191 | A | 11/2010 |
| KR | 10-2017-0093674 | A | 8/2017 |
| WO | 2016/092049 | A1 | 6/2016 |

OTHER PUBLICATIONS

Notice of Reasons for Rejection dated Mar. 8, 2021, issued in Japanese Application No. 2020-512633, filed Sep. 1, 2017, 8 pages.
International Search Report dated Nov. 27, 2017, issued in corresponding International Application No. PCT/JP2017/032389, filed Sep. 1, 2017, 2 pages.
Notice of Allowance dated Nov. 1, 2021, issued in Korean Application No. 10-2020-7007453, filed Mar. 13, 2020, 4 pages.
First Office Action dated Feb. 7, 2022, issued in corresponding Chinese Patent Application No. 201780094461.1, filed Sep. 1, 2017, 23 pages.
Chinese Office Action dated Dec. 15, 2022, issued in corresponding Chinese Patent Application No. 201780094461.1, filed Sep. 1, 2017, 22 pages.

* cited by examiner

COUPE A-A

COUPE C-C

STEM WITH BAYONET CLOSURE AND DEVICE EQUIPPED THEREWITH

TECHNICAL FIELD

Several type of devices exist for applying cosmetic products. Some of them consist of a bottle for holding a product, a cap for closing the bottle and containing the product, and an application member protruding at the end of a stem. The invention relates to a simplified sealing cap, as well as a cosmetic device equipped therewith.

The cosmetic product can be a care or a makeup product such as a mascara, eye liner, foundation, blusher, eyeshadow, lipstick, lip gloss or lip balm.

Within the meaning of the present invention, a "cosmetic product" is understood to be a cosmetic product intended to be applied to a human being, for example a solid such as a powder, a liquid or a cream. A "cosmetic product" is more generally a product as defined in Regulation (EC) No 1223/2009 of the European Parliament and of the Council of 30 Nov. 2009 on cosmetic products.

BACKGROUND ART

Sealing caps for cosmetic devices, which are composed of a tubular cap body, are widely used in the cosmetics industry. As a rule, when the sealing cap is completely closed, it is pressed against the bottle neck or against the rim of the stripper protruding from this neck, in order to reliably seal the cosmetic receptacle.

In order to be able to exert the sealing pressure required for this as conveniently as possible, the cap body is provided, usually on its inner circumferential surface, with a thread profile that protrudes relatively far in the radial direction into the open space encompassed by the cap body.

It has, however, long been known that the thread stands in the way of a truly efficient manufacture of the sealing cap. To remove the completed injection molded sealing cap from the mold, the two mold halves are pulled apart from each other in the direction parallel to the longitudinal axis of the sealing cap. However, the sealing cap is not completely free and can remain attached to the mold half.

A similar problem can arise in the manufacture of a sealing cap that does not in fact have a thread profile, but instead has a bayonet closure. Such a closure likewise functions with a holding projection that protrudes from the cap relatively far in the radial direction into the open space encompassed by the cap body.

US2011222955 discloses an injection-molded plastic process for manufacturing a sealing cap connected to the receptacle by means of a click-and-close closure or bayonet. The injection mold is designed specifically so that for the removal procedure, the at least two parts of the mold can be moved away from each other in the direction of the longitudinal axis of the device. To fit the mold, one part of the click-and-close closure or bayonet protrudes from the handle and the other one, from the bottle. Nevertheless, the diameters of the stem and the cap are quite large.

For some make-up products, it would be desirable to diminish the diameter of the stem. This would be particularly interesting for a product aiming to a precise and fine make-up.

In light of this, an object of the invention is to provide a cosmetic device of the type described above that can be even more efficiently manufactured, comprises a thin and long stem, comprises a thin cap, is light, and is ergonomic.

SUMMARY OF THE INVENTION

The present invention therefore relates to a cosmetic device of longitudinal axis X comprising a bottle of product comprising a top free edge defining an opening, a detachable cap comprising a handle arranged at a first end of a stem, a second end of the stem being fastened to an application member, the stem comprises a first relief able to removably engage in a second complementary relief arranged on the bottle, between an open position where the application member can emerge from the bottle and a closed position where the application member is retracted in the bottle.

Thanks to the position of the reliefs on the stem and on the bottle, the device is not only easy to manufacture but it can also offer to the consumer a long a thin stem that makes the make-up easier, especially the application of mascara. Such a long and thin stem was not possible when the reliefs where positioned on the bottle and on the handle.

Such a device therefore makes it possible to create new make-up gestures for improved results, even for the eyes.

The invention also relates to a detachable cap suitable to be attached on the bottle of cosmetic product, the cap a comprising a handle arranged at a first end of a stem, a second end of the stem being fastened to an application member, a first relief is arranged on the stem and is able to mechanically engage in a second complementary relief of the bottle.

The invention also relates to a cosmetic process comprising the opening and the closure of a cosmetic device as described here before, by snap-fitting the first relief of the stem in the second complementary relief of the bottle.

Maind Definitions

The "axis A" means the longitudinal axis A.

A "cross section of a part of axis A" is a section perpendicular to the axis A of the part.

The expression "longitudinal axis of the part x" denotes the line connecting all of the centers of mass of the cross sections of the part x.

A "handle" is a gripping part forming the top of the cap.

BRIEF DESCRIPTION OF DRAWINGS

The invention may be better understood on reading the following detailed description, made with reference to the accompanying drawings illustrating a non-limiting embodiment of the latter, and in which.

MODES FOR CARRYING OUT THE INVENTION

Figure 1:
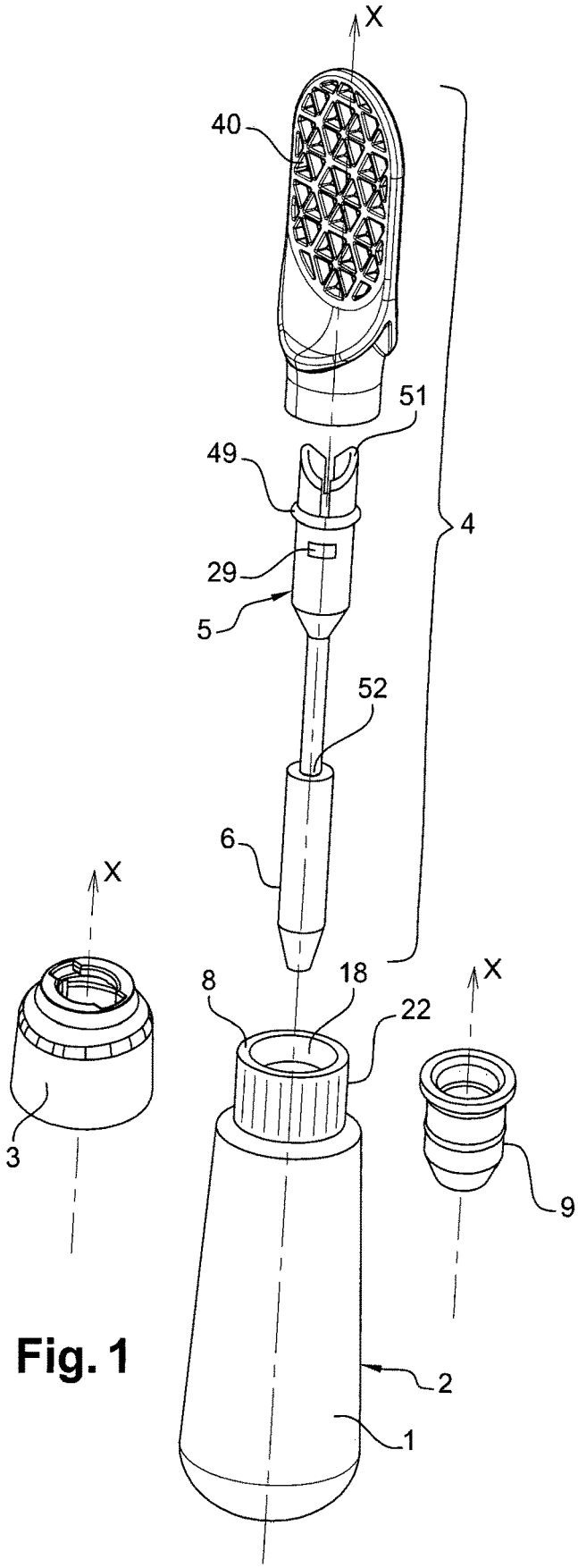
FIG. 1 is an exploded view in perspective of an embodiment of a device according to the invention.
Figure 2:
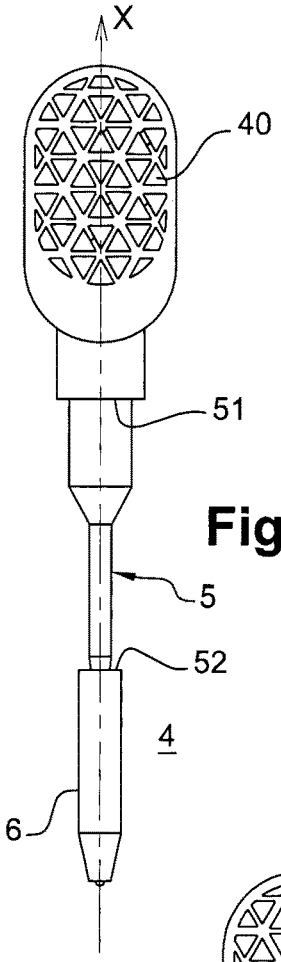
FIG. 2 is an assembled view in perspective of the cap shown in FIG. 1.
Figure 3:
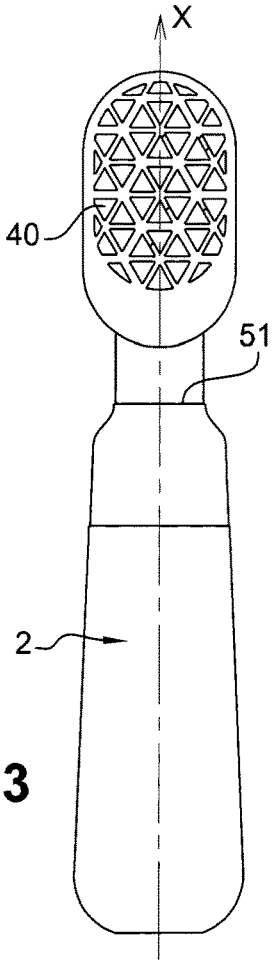
FIG. 3 is an assembled view in perspective of the device shown in FIG. 1 in closed position.
Figure 4:
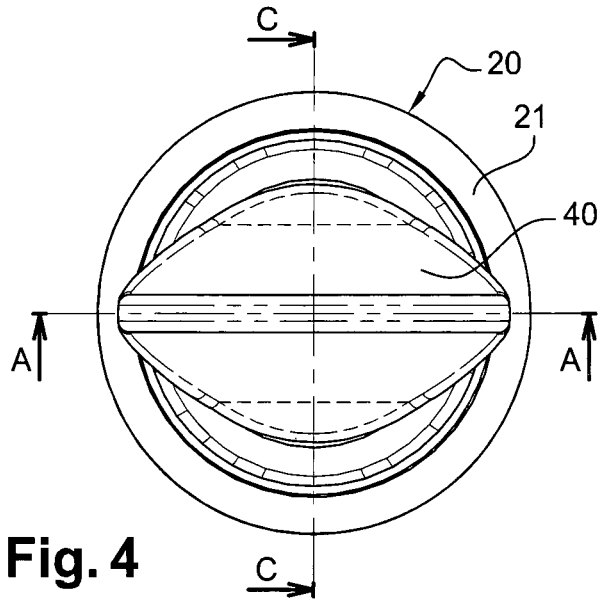
FIG. 4 is a top view of the device shown in FIG. 1.

FIGS. 1 to 8 show an embodiment of a cosmetic device according to the invention having a longitudinal axis X. Such a device may comprise, on the one hand, a bottle 2 and, on the other hand, a cap 4. The bottle 2 may comprise a reservoir 20 and a collar 3. The cap 4 may comprise a handle 40 mounted at a first end 51 of a stem 5, a second end 52 of the stem 5 being fastened to an application member 6.

The bottle 2 and the cap 4 can be made of thermoplastic materials, notably produced from ABS, PP or PET/PETG. The stem 5 can be made of PBT.

The bottle 2 can be equipped with a wiper 9, for example made of LDPE.

As a variant, the bottle and the cap may be made by injection, including overmoulded or bi-injected.

The application member 6 may comprise application means configured for spreading a cosmetic product on a bodily application surface, such as the face, the lips, the eyes, the cheeks or keratinous fibers. This application member 6 may, for example, be chosen from a sponge, a puff, a brush or a comb. The cosmetic device can be a mascara brush or a gloss applicator.

The application member 6 and the handle 40 may be fitted and attached directly to the stem 5. Examples of such attachment means may, for example, comprise a tightening sleeve-fitting, a snap-fitting, a screwing, a bonding, a welding or other. As a variant, they may be made in a single piece with stem 5.

Figure 7:
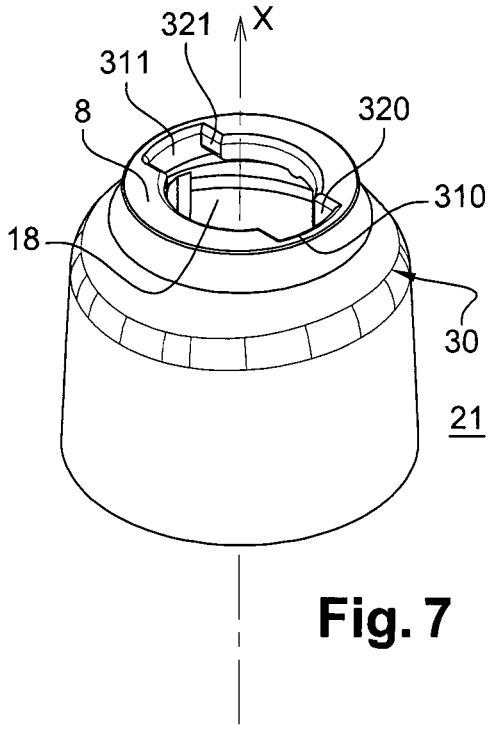
FIG. 7 is a view in perspective of the ring shown in FIG. 1.
Figure 8:
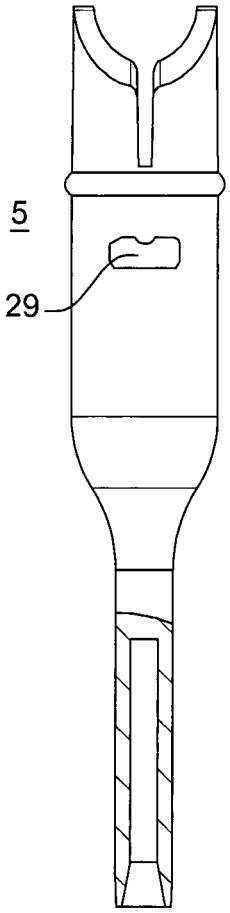
FIG. 8 is a side view of the stem shown in FIG. 1.
Figure 5:
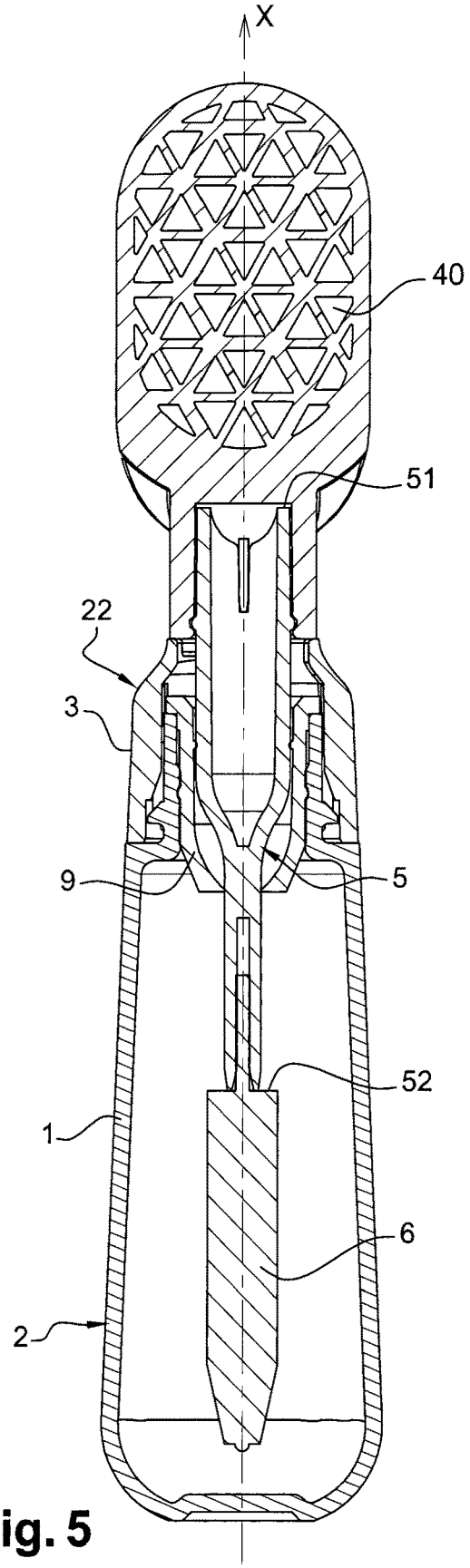
FIG. 5 is a view in longitudinal section on the axis A-A of the device shown in FIG. 4.

As visible on FIG. 8, the stem 5 comprises a first relief 29 that extends outwards the stem perpendicularly to the X axis. It is able to mechanically engage in at least a second complementary relief 310 arranged on the bottle 2 (FIG. 7) and preferably extending from the top free edge 8 of the bottle 2 defining an opening 18.

Advantageously, the cap 4 may be mounted removably on the bottle 2 by a bayonet system. It could also be a snap-fit system or a clipping system.

On the figures, the bottle 2 comprises a socket 30.

The cap 4 may also be snap-fitted onto the bottle 2 while being allowed to be rotated relative to this bottle 2.

Preferably, the bottle 2 comprises a neck 22 and the second relief 310 is placed on the neck 22. This way, the movement to close and open the device is easier for the consumer.

In one embodiment, the bottle 2 is in one piece.

In another embodiment, the bottle 2 comprises a collar 3 mounted on a reservoir 1. The sealing area is easier to manufacture, especially because the second complementary relief 310 can be arranged on the collar 3. This way, the second relief 310 is not directly placed on a neck made in one piece with the bottle 2.

Advantageously, the second relief 310 of the bottle 2 comprises a recess. The recess can be a notch, a cavity, a hole, an emptiness, a groove, a slot, a channel. The gesture is then more simple for the user. Such reliefs can be made in one piece with the bottle 2.

As illustrated on FIG. 7, the bottle 2 comprises two second reliefs 310 and 311 symmetrically opposed one to another with respect to the longitudinal axis X and defining notches that extend parallel to the longitudinal axis X. The closure of the device is tight. In that case, the stem also comprises two first reliefs 29 and 49.

The second reliefs 310 and 311 of the bottle 2 define a sliding path comprising a sliding edge 320 and 321 suitable for guiding the movement of the first relief 29 and 49 of the stem 5 parallel to the X axis between a high position to a low position. This movement is quite natural for the user.

In an embodiment, the sliding path comprises two sectors of sliding path extending in at least two distinct general directions, or profiles. The closure is tighter and easy for the user. In this case, the first reliefs 29 and 49 can be guided around the X axis, in order to reach a final position after they have reached the low position.

It may also comprise a third sliding path sector. These sectors may have distinct directions or profiles. A sector may comprise a sliding edge that is substantially circular or horizontal. This second sector may lead to the third sector. A sector may comprise a ramp. The ramp might be provided with a plurality or succession of irregularities, such notches or tooth.

The first relief 29 and 49 of the stem 5 comprises a protrusion, such as a bead, a tooth, a claw or a lug. Such reliefs can be made in one piece with the stem 5.

Figure 6:
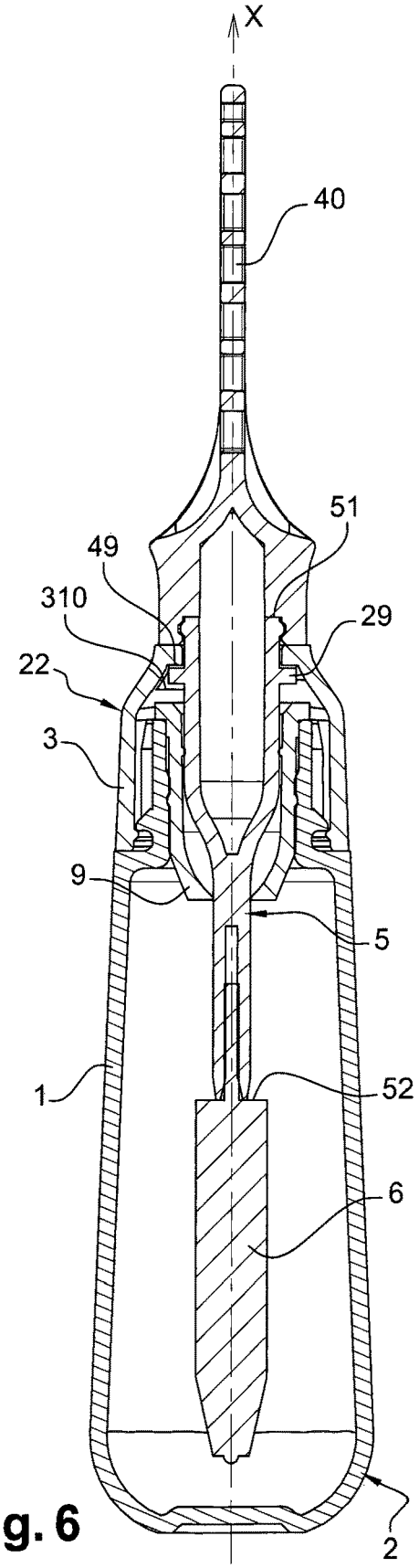
FIG. 6 is a view in longitudinal section on the axis C-C of the device shown in FIG. 4.

FIG. 6 shows the stem 5 in the low position relative to the bottle 2. In this position, the lugs 29 and 49 can occupy a position in which they are facing the notches 310 and 311. In this position, these lugs 29 and 49 extend level with the respective insertion end of the passageway. They are blocked at the end of the sliding path parallel to the X longitudinal axis.

The apparent length of the stem is longer than for known devices, as no big cap is covering the stem with a thread. The stem and its cap appear finer as for known devices, which provides a good accessibility to the stem and to the application member 6. The variation of the diameter between the cap and the stern is smaller than for known devices. This gives a smart shape to the device according to the invention and the make-up is easier.

To use the device, the user can, with one hand, take hold of the bottle 2 and, with the other, take cap 4. To close the device, he inserts the application member 6 into the bottle 2 and adjusts the position of the stem to be able to position the lugs 29 and 49 across from the notches 310 and 311. He guides the stem into the notches 310 and 311 from its high position to its low position relative to the bottle 2. Then, he turns the cap 4 relative to the bottle 2. This rotary movement causes a secured rotary movement of the application member 6 that is housed in the bottle 2. Obviously, numerous modifications and variations of the present invention are possible in light of the above teachings.

It is therefore to be understood that within the scope of the appended claims, the invention may be practiced otherwise than as specifically described therein.

Especially, a plate may be mounted above the reliefs, in order to improve their contact. This also guarantees the click closure as the distance between the plate and the reliefs is given.

The invention claimed is:

1. Cosmetic device of longitudinal axis X comprising a bottle of product comprising a top free edge defining an opening, a detachable cap comprising a handle arranged at a first end of a stem, a second end of the stem being fastened to an application member, wherein the stem comprises a first relief able to removably engage in a second complementary relief arranged on the bottle, between an open position where the application member can emerge from the bottle and a closed position where the application member is retracted in the bottle, wherein the bottle comprises a neck and a reservoir, a collar mounted on the reservoir, wherein the collar surrounds an exterior of the neck, and the second complementary relief is arranged on an upper end of the collar.

2. Cosmetic device according to claim 1, wherein the second complementary relief extends from the top free edge of the bottle.

3. Cosmetic device according to claim 1, wherein the first relief extends outwards the stem perpendicularly to the X axis.

4. Cosmetic device according to claim 1, wherein the second relief of the bottle comprises a recess.

5. Cosmetic device according to claim 1, wherein the first relief of the stem comprises a protrusion.

6. Cosmetic device according to claim 1, wherein the second complementary relief of the bottle defines a sliding path comprising a sliding edge suitable for guiding the movement of the first relief of the stem parallel to the X axis between a high position to a low position.

7. Cosmetic device according to claim 6, wherein the sliding path comprises two sectors of sliding path extending in at least two distinct general directions, or profiles.

8. Cosmetic device according to claim 1, wherein the bottle comprises a socket extending around the stem.

9. Cosmetic device according to claim 1, wherein the bottle comprises two second complementary reliefs symmetrically opposed one to another with respect to the longitudinal axis X.

10. Cosmetic device according to claim 1, wherein the cap is mounted removably on the bottle by a bayonet system, a snap-fit system or a clipping system.

11. Cosmetic process comprising the opening and the closure of a cosmetic device according to claim 1 by snap-fitting the first relief of the stem in the second complementary relief of the bottle.

12. Detachable cap suitable to be attached on a bottle of a cosmetic product, the cap comprising a handle arranged at a first end of a stem, a second end of the stem being fastened to an application member, wherein a first relief is arranged on the stem and is able to mechanically engage in a second complementary relief of the bottle, wherein the bottle comprises a neck and a reservoir, a collar mounted on the reservoir, wherein the collar surrounds an exterior of the neck, and the second complementary relief is arranged on an upper end of the collar.

* * * * *